US011465655B2

(12) United States Patent
Crisafulli et al.

(10) Patent No.: US 11,465,655 B2
(45) Date of Patent: Oct. 11, 2022

(54) RAILCAR SIDE WALL FABRICATION AND OFFSET OVERLAP WELDING OF SHEETS

(71) Applicant: Trinity Rail Group, LLC, Dallas, TX (US)

(72) Inventors: Christopher Crisafulli, Mansfield, TX (US); Matthew Gabriel Westlake, Dallas, TX (US); Suman Gachhadar, Frisco, TX (US); Percy Elavia, Plano, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 428 days.

(21) Appl. No.: 16/579,156

(22) Filed: Sep. 23, 2019

(65) Prior Publication Data

US 2020/0094856 A1 Mar. 26, 2020

Related U.S. Application Data

(60) Provisional application No. 62/734,758, filed on Sep. 21, 2018.

(51) Int. Cl.
*B61D 17/08* (2006.01)

(52) U.S. Cl.
CPC ..... *B61D 17/08* (2013.01)

(58) Field of Classification Search
CPC ..... B61D 17/08; B62D 25/025
See application file for complete search history.

(56) References Cited

U.S. PATENT DOCUMENTS

2005/0076805 A1* 4/2005 Creighton ..... B61D 17/18 105/404

FOREIGN PATENT DOCUMENTS

WO WO-2014010001 A1 * 1/2014 ..... B61D 17/08

* cited by examiner

*Primary Examiner* — Robert J McCarry, Jr.
(74) *Attorney, Agent, or Firm* — Baker Botts, LLP

(57) ABSTRACT

A side wall for a railcar includes a plurality of integrated side sheets. Each of the integrated side sheets includes a sheet of metal having a top side edge and a bottom side edge extending from a first end to a second end of the sheet of metal. The sheet of metal further includes a flat area portion extending a first distance from the first end towards the second end between the top side edge and the bottom side edge. The sheet of metal further includes a side post portion adjacent to the flat portion, the side post portion comprising a plurality of bends forming a recess. The plurality of bends forming the recess includes at least a first bend, a second bend, a third bend, and a fourth bend. Adjacent integrated side sheets may be coupled together to form the side wall.

16 Claims, 8 Drawing Sheets

RAILCAR SIDE WALL FABRICATION AND OFFSET OVERLAP WELDING OF SHEETS

RELATED APPLICATIONS

This application claims the benefit under 35 U.S.C. 119(e) of the priority of U.S. Provisional Application No. 62/734,758 entitled "RAILCAR SIDE WALL FABRICATION AND OFFSET OVERLAP WELDING OF SHEETS" filed on Sep. 21, 2018. the entire disclosure of which is hereby incorporated by reference.

TECHNICAL FIELD OF THE DISCLOSURE

This disclosure relates generally to railcar construction, and more particularly to fabrication of a railcar side wall using offset overlap welding of sheets.

BACKGROUND

Rail cars are an integral part of transporting freight and cargo across the country. Railcars, such as box cars can be constructed using metal components, such as sheets and bars of steel and aluminum. The side walls of box cars, for example, have conventionally been constructed using flat sheets of metal welded together and buttressed with a side (or door) post welded to the sheets. For example, a side wall of a box car may include a side post plug welded to side sheets and side sheets butt welded to each other. While this process may create a smooth interior surface for the railcar, it also requires significant amounts of welding the different components together. The amount of welding contributes significantly to construction limes of the railcar and creates many weld joints that may wear and potentially fail over the operation of the railcar.

SUMMARY OF THE DISCLOSURE

According to one embodiment, a side wall for a railcar includes a plurality of integrated side sheets. Each of the integrated side sheets comprises a sheet of metal includes a first end and a second end opposite the first end and a top side edge and a bottom side edge extending from the first end to the second end. The sheet of metal further includes a flat area portion and a side post portion adjacent to the flat area portion. The flat area portion extends a first distance from the first end towards the second end between the top side edge and the bottom side edge. The side post portion is adjacent to the flat portion and includes a plurality of bends forming a recess. In some embodiments, the plurality of bends includes first, second, third, and fourth bends. The sheet of metal extends a second distance at a first, non-zero angle relative to the flat area portion between the first bend and the second bend. The sheet of metal extends a third distance parallel to the flat area portion between the second bend and the third bend. The sheet of metal extends a fourth distance at a second, non-zero angle relative to the flat area portion between the third bend and the fourth bend. The side post portion further includes an end portion extending a fifth distance parallel to the flat area portion from the fourth bend towards the second end of the sheet of metal.

In particular embodiments, the plurality of bends further includes a fifth bend and sixth bend between the first bend and the second bend of the sheet of metal. The sheet of metal extends for a first portion of the second distance at a third, non-zero angle relative to the flat area portion between the first bend and the fifth bend. The sheet of metal extends for a second portion of the second distance parallel to the flat area portion between the fifth bend and the sixth bend. Further, the sheet of metal extends for a third portion of the second distance al a fourth, non-zero angle relative to the flat area portion between the sixth bend and the second bend.

In particular embodiments, a first integrated side sheet of the plurality of the integrated side sheets is disposed adjacent to a second integrated side sheet of the plurality of side sheets. The respective first end of the second integrated side sheet is disposed proximate to the respective first bend of the plurality of bends of the respective side post portion of the sheet of metal of the first integrated side sheet.

In another embodiment, a method for constructing a side wall for a railcar is provided. The method includes fabricating one or more integrated side sheets. Fabricating each integrated side sheet includes obtaining a metal sheet having predetermined dimensions and forming a recess in the metal sheet. Forming the recess in the metal sheet includes forming first, second, third, and fourth bends in the metal sheet. The first bend is formed at a first distance from a first end of the metal sheet. The first bend in the metal sheet defines a flat area portion between the first end and the first bend and a side post portion between the first bend and a second end of the metal sheet opposite the first end. The metal sheet extends a second distance at a first, non-zero angle relative to the flat area portion between the first bend and the second bend. The metal sheet extends a third distance parallel to the flat area portion between the second bend and the third bend. The metal sheet extends a fourth distance at a second, non-zero angle relative to the flat area portion between the third bend and the fourth bend. The fourth bend forms an end portion extending a fifth distance parallel to the flat area portion from the fourth bend toward the second end of the metal sheet. The method further includes welding the one or more integrated side sheets together to form a side wall for a railcar.

In particular embodiments, forming the recess in the metal sheet further includes forming an offset bend. Forming the offset bend includes forming fifth and sixth bends in the metal sheet. The fifth bend is formed between the first bend and the second bend of the metal sheet. The metal sheet extends for a first portion of the second distance at a third, non-zero angle relative to the flat area portion between the first bend and the fifth bend. The sixth bend is formed between the fifth bend and the second bend of the metal sheet. The metal sheet extends for a second portion of the second distance parallel to the flat area portion between the fifth bend and the sixth bend and extends for a third portion of the second distance at a fourth, non-zero angle relative to the flat area portion between foe sixth bend and foe second bend. The offset bend is configured to accommodate an adjacent portion of an integrated side sheet such that adjacent integrated side sheets are aligned.

Certain embodiments disclosed herein may contain or embody one or more technical advantages. As an example, certain embodiments may allow for the reduction or simplification of foe welding used to fabricate a side wall of a railcar. For example, side sheets with integrated side posts may be used to construct the side wall by overlapping portions of the side sheets and welding the ends of each side sheet to the adjacent side sheet. As another example, certain embodiments may simplify the construction of a side wall of a railcar by integrating elements into a single. repeatable side sheet structure. For example, an integrated side sheet may be provided that includes art integrated side post formed by bending portions of the side sheet. The integrated side sheet may further include depressions for attaching lading anchors within the interior of the fabricated railcar. Further, a side wall constructed with integrated side sheets may obviate the use of other side wall components, such as separate side posts, thereby reducing the number of parts used.

Other objects, features, and advantages of the present disclosure are apparent to persons of ordinary skill in the art in view of the following detailed description of the disclosure and the accompanying drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Certain embodiments of the present disclosure and inventive concepts, and their features and advantages, may be understood by referring to FIGS. 1-8, like numerals being used for corresponding parts in the various drawings.

Figure 1:
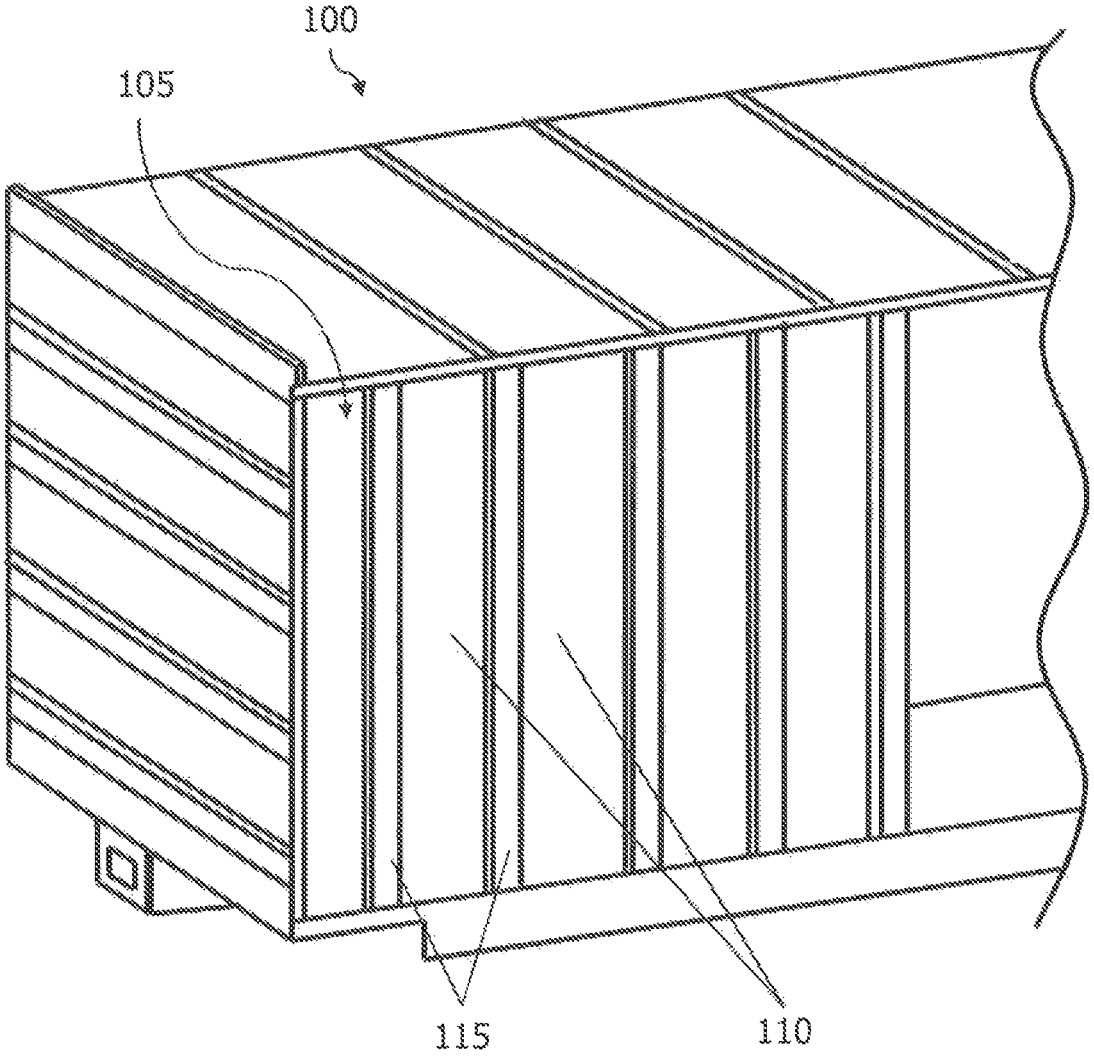
FIG. 1 illustrates an example boxcar with conventional side wall construction, in accordance with certain embodiments.

FIG. 1 illustrates an example railcar 100 with conventional side walls 105, in accordance with certain embodiments. Railcar 100 may represent any type of railcar, including a boxcar or any other railcar that may include side walls. Railcar 100 includes side walls 105 that are fabricated in a conventional manner using a combination of side sheets 110 and side posts 115. Side sheets 110 may be flat sheets of metal, such as aluminum, steel, or any alloys or composites thereof. Side sheets 110 may be arranged end to end along the length of railcar 100. Side sheets 110 may be joined together at their ends using any suitable method, such as by welding side sheets 110 together. Side posts 115 may be coupled to side sheets 110 to reinforce the structure of side sheets 110 to form side wall 105. For example, side posts 115 may be arranged vertically and spaced along the length of railcar 100 and rigidly secured thereto. In certain embodiments, side posts 115 may be welded, e.g., plug welded, to side sheets 110.

Figure 2:
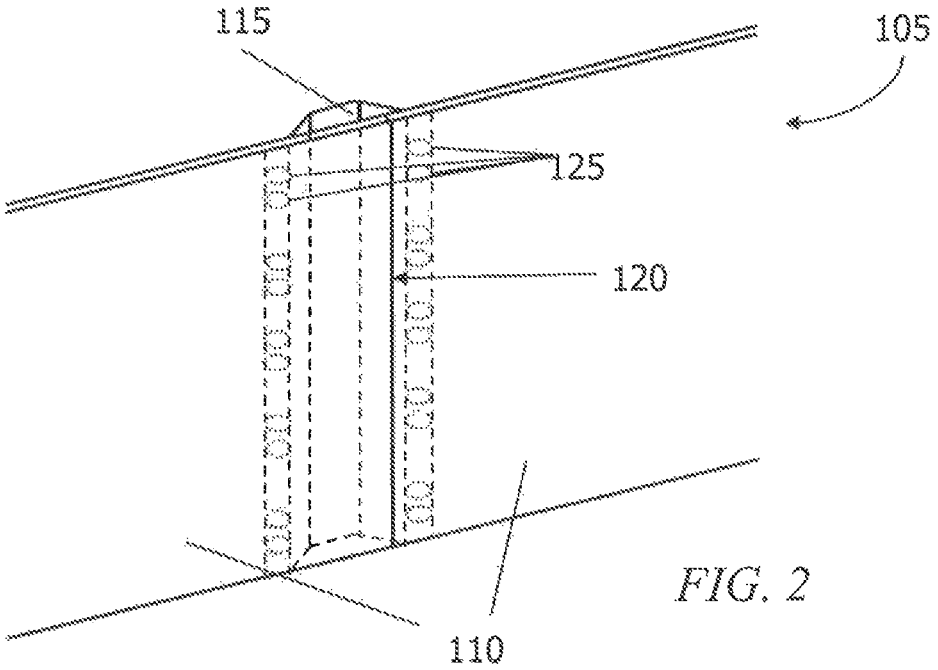
FIG. 2 illustrates an isometric view of the interior side of the side wall of the example railcar, in accordance with certain embodiments.

FIG. 2 illustrates an isometric view of the interior side of the side wall 105 of the railcar 100. As discussed above, conventional fabrication of side walls 105 for a railcar may include the combination of flat side sheets 110 and side posts 115. In order to fabricate side wall 105, a number of welds may be made to ensure that these various components are secured together. For example, side sheets 110 may be welded together end-to-end using a bun weld 120. Further, side post 115 may be welded to side sheets 110, such as by using one or more plug or stitch welds 125. In this manner, side wall 105 may be fabricated to have a smooth interior surface for railcar 100. However, such a construction also requires significant amounts of welding of different components, e.g., through butt weld 120 and plug welds 125. Additionally, side posts 115 may require further welding, such as a continuous weld down each of the ends of side posts 115 to flat side sheets 110. This amount of welding contributes significantly to construction times of railcar 100 and may create a large number of weld joints that may wear and potentially fail over the operation of railcar 100.

Accordingly, this disclosure provides methods and apparatuses for overcoming the challenges discussed above and improving the manufacturability of railcar side walls by providing new side wall components and methods for using said side wall components in fabricating the side wall. Certain embodiments disclosed herein may include one or more technical advantages that address the challenges of conventional side wall construction, as may be apparent from detailed description of embodiments and examples below.

Figure 3:
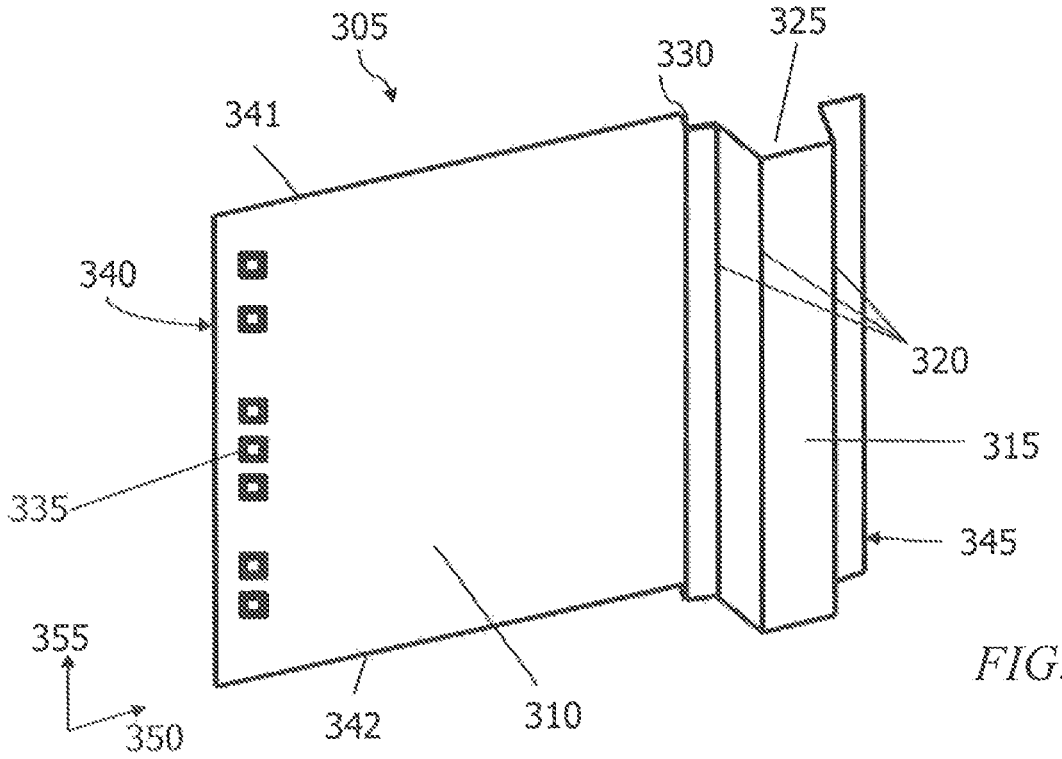
FIG. 3 illustrates an example integrated side sheet, in accordance with certain embodiments.

FIG. 3 illustrates an example integrated side sheet 305 that may replace conventional side sheets 110 and side posts 115. In certain embodiments, integrated side sheet 305 may include a flat portion 310 and a side post portion 315 formed in a single component. Flat portion 310 may begin at a first end 340 of integrated side sheet 305 and extend along a first direction 350 between a top side edge 341 and a bottom side edge 342 until side post portion 315, which may extend towards the opposite second end 345 between top side edge 341 and bottom side edge 342. Side post portion 315 may replace the structural support that conventional side post 115 provides without welding a separate component to integrated side sheet 305. In some embodiments, side post portion 315 may include one or more bends 320 that create a recess 325 within integrated side sheet 305. In some embodiments, side post portion 315 includes two, three, or four bends 320. Bends 320 may be made sharply or may be curved to reduce the strain on integrated side sheet 305 when bends 320 are made.

In certain embodiments, integrated side sheet 305 may be constructed from a monolithic sheet of metal. For example, integrated side sheet 305 may be fabricated from a flat sheet of metal by bending it at predetermined locations along its length to form side post portion 315 from bends 320. For example, a sheet of metal may be fed into a metal sheet bending machine along the first direction 350 and bent after certain lengths of the sheet of metal is fed into the machine. In this manner, a side post portion 315 may be formed extending along the second direction 355 perpendicular to the first direction 350.

In certain embodiments, side post portion 315 is tapered. In some embodiments, tapering may be provided by including bends 320 differing from 90 degrees angles. For example, bends 320 may be made at alternating 70 degrees and 110 degrees angles to form a tapered side post portion 315. In some embodiments, side post portion 315 is symmetrical along first direction 350, Alternatively, side post portion 315 may be asymmetrical along first direction 350.

In certain embodiments, side post portion 315 is not tapered. For example, side post portion 315 may include three 90-degree bends to form a box-like recess. Any suitable shape of side post portion 315 may be used and is contemplated in this disclosure.

In certain embodiments, side post portion 315 further includes offset bend 330 between side post portion 315 and flat portion 310. Offset bend 330 may provide an indentation within integrated side sheet 305 configured to receive first end 340 of fiat portion 310 of an adjacent integrated side sheet 305. In this manner, at both ends 340, 345 of integrated side sheet 305, a relatively flat surface is provided. Further description of offset bend 330 is provided below in reference to FIG. 4C.

In certain embodiments, integrated side sheet 305 further includes one or more depressions 335. Depressions 335 may be located at any suitable portion of integrated side sheet 305. Depressions 335 may be the location for placing a lading anchor or another anchor for use within the interior of a railcar, such as to anchor cargo and freight within a boxcar. In some embodiments, depressions 335 may be located on fiat portion 310 of integrated side sheet. In some embodiments, depressions 335 may be covered by an overlapping portion of an adjacent integrated side sheet 305. In some embodiments, each integrated side sheet 305 includes more than one depressions 335. In some embodiments, only some integrated side sheets 305 used to construct a side wall of a railcar include depressions 335. In some embodiments, each integrated side sheet 305 includes identical depressions 335. In this manner, the fabrication of integrated side sheets 305 may be standardized such that only one construction is needed for all integrated side sheets 305, thereby further improving the manufacturability of side walls for railcars.

In certain embodiments, integrated sides sheets 305 may include further integrated structures that further strengthen side wall in which integrated side sheets 305 are used. For example, one or more supporting structures, such as ribs or depressions along flat portion 310, may be formed in integrated side sheets 305. In some embodiments, supporting structures are provided within integrated side sheets 305 during the fabrication process in which recess 325 and/or offset bend 330 are provided. In some embodiments, supporting structures are provided in a separate process. In this manner, integrated side sheets 305 may be further strengthened or stiffened.

Figure 4A:
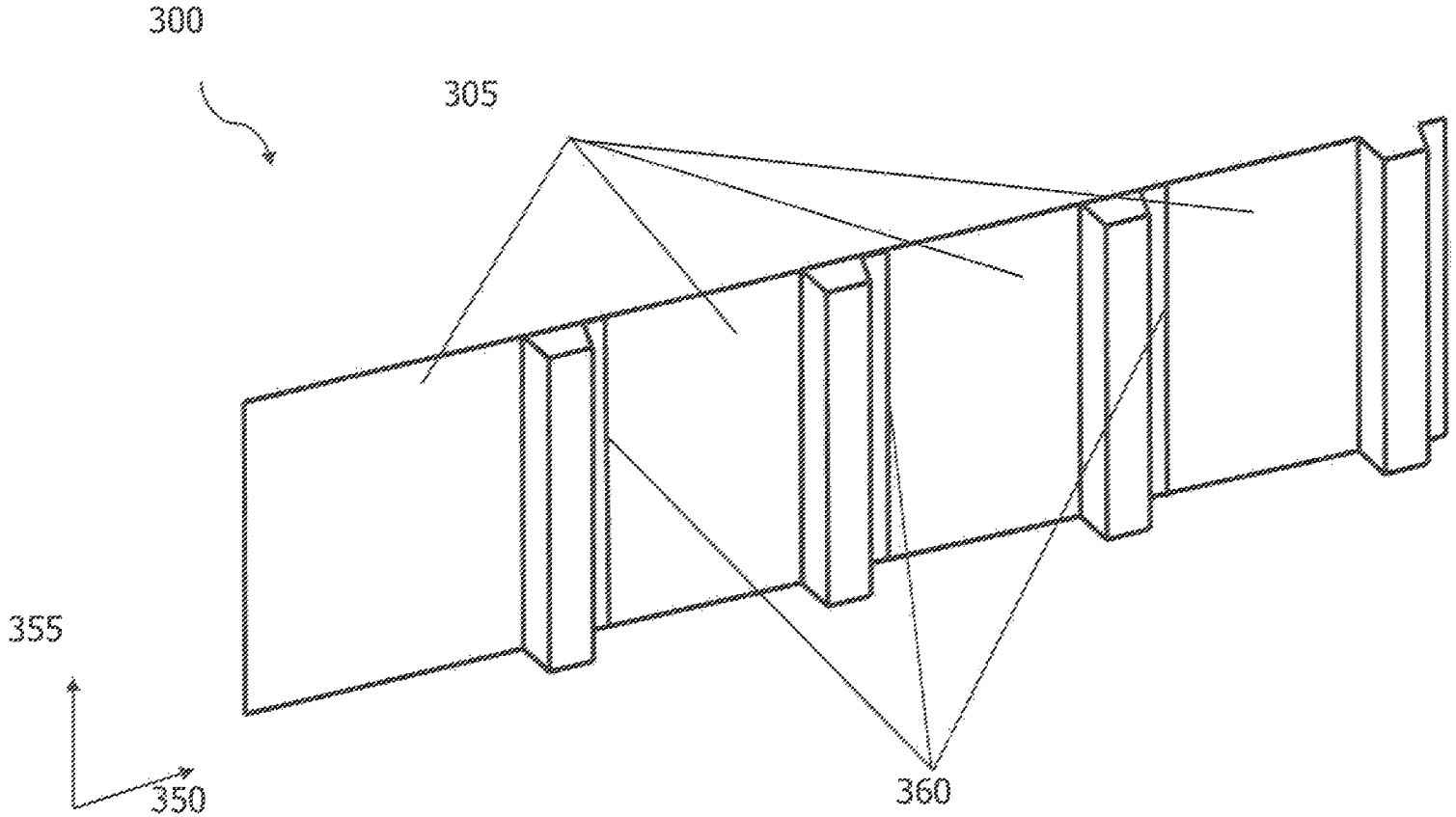
FIGS. 4A and 4B illustrate isometric views of an example side wall constructed using a plurality of the example integrated side sheets, in accordance with certain embodiments.
Figure 4B:
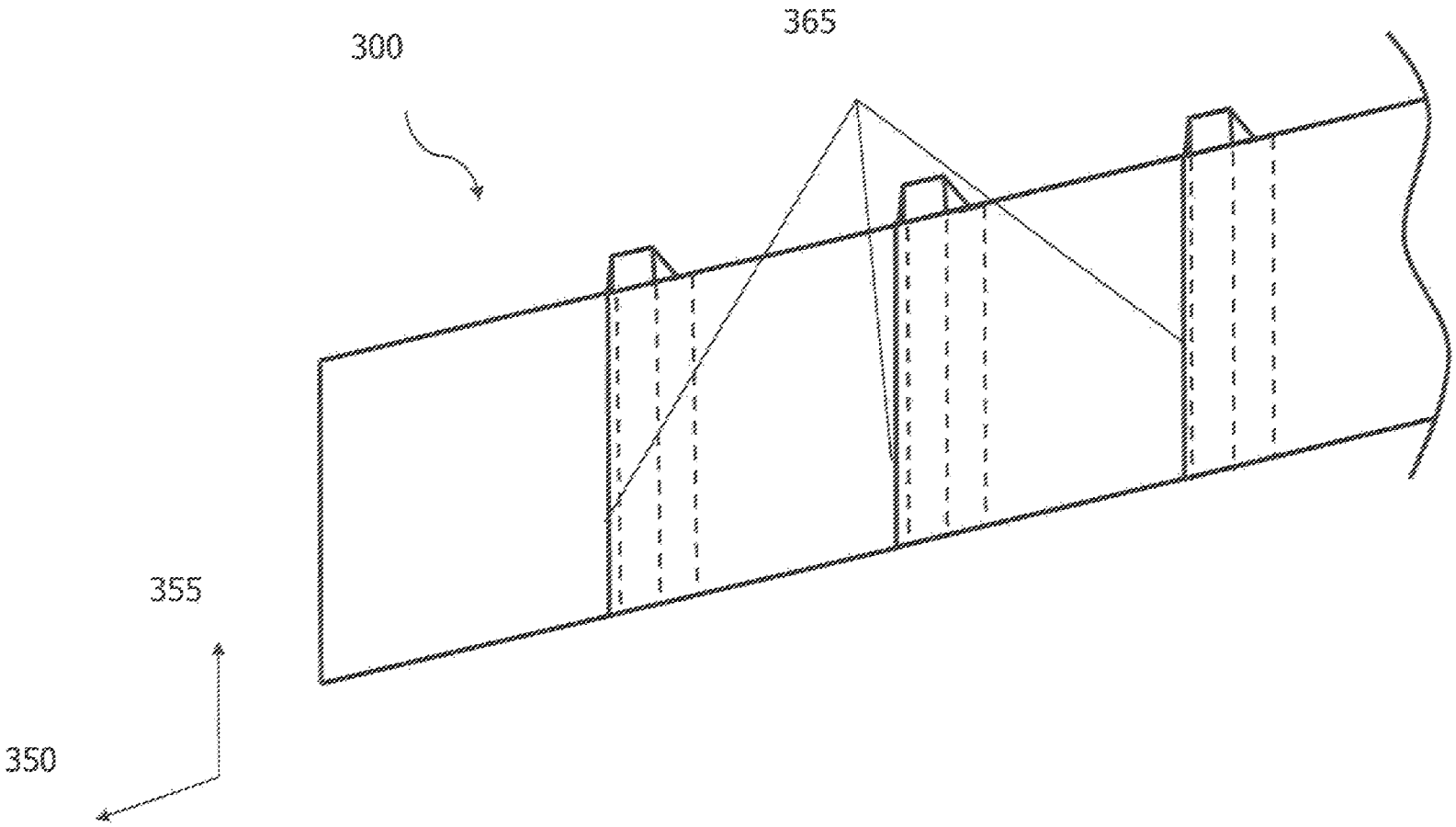

FIGS. 4A and 4B illustrate isometric views of an example side wall 300 constructed using a plurality of the integrated side sheets 305. FIG. 4A illustrates the exterior facing view of side wall 300 fabricated using integrated side sheets 305. In certain embodiments, side wall 300 is fabricated by overlapping portions of adjacent integrated side sheets 305 and fastening said adjacent side sheets 305 together. In some embodiments, flat portion 310 of a first integrated side sheet 305 overlaps with a second integrated side sheet 305 such that flat portion 310 of the first integrated side sheet 305 covers recess 325 of the second integrated side sheet 305. This overlapping may continue using a predetermined number of integrated side sheets 305 to achieve a desired length of side wall 300.

Adjacent integrated side sheets 305 may be easily fastened together. For example, as depicted in FIG. 4A, welds 360 may be made on the exterior side of side wall 300 between adjacent integrated side sheets 305. Welds 360 may be made along second direction 355 between second end 345 of a first integrated side sheet 305 and flat portion 310 of a second integrated side sheet 305. In some embodiments, integrated side sheet 305 includes offset bend 330, thereby providing a flat portion proximate second end 345 of integrated side sheet 305. This may improve the manufacturability by creating a flat surface that is substantially parallel to flat portion 310 of the adjacent integrated side sheet 305, which may be easier to weld between.

FIG. 4B illustrates the interior facing view of side wall 300 fabricated using integrated side sheets 305. In certain embodiments, the interior facing side of side wall 300 may be substantially flat. By providing flat surfaces within the railcar, cargo and/or freight may be more easily loaded and unloaded into the interior of the railcar. The flat surface of side wall 300 may be achieved using the overlapping procedure discussed above to create side wall 300 out of integrated side sheets 305. As illustrated, only flat portions 310 of integrated side sheets 305 are exposed on the interior facing side of side wall 305. Thus, if properly aligned, the overlapping integrated side sheets 305 may form a substantially flat surface for the interior facing side of side wall 305.

Adjacent integrated side sheets 305 may be further fastened together in addition to the welds on the exterior facing side shown in FIG. 4A. For example, adjacent integrated side sheets 305 may be further welded on the interior facing side of side wall 305. In some embodiments, welds 365 extending in the second direction 355 arc provided to further fasten adjacent integrated side sheets 305. For example, first end 340 of a first integrated side sheet 305 may be welded to a second integrated side sheet 305 at its respective flat portion 310 near the first of bends 320 forming side post portion 313 of the second integrated side sheet 305. In this manner, the first integrated side sheet 305 may cover recess 325 of the second integrated side sheet 305 and provide a flat surface on the interior facing side of side wall 300.

In certain embodiments, the overlap between adjacent integrated side sheets 305 is minimized only to cover recesses 325 of integrated side sheets 305. For example, respective flat portions 310 of adjacent integrated side sheets 305 may only overlap a length along the first direction 350 sufficient to allow the fastening, e.g., welding, of adjacent integrated side sheets 305. As a result, unnecessary overlap may be avoided, which may aid in maintaining a consistent, smooth interior surface of side wall 300 and avoid using unnecessary material in fabricating side wall 300.

In certain embodiments, various dimensions of integrated side sheet 305 may be adjusted for use in fabricating particular side walls 300. For example, the proportion of the length of flat portion 310 to integrated side sheet 305 may be adjusted to increase or decrease the spacing of side post portions 315. As another example, the height in the second direction 355 may be adjusted based on the desired height of side wall 300, which may be based on the type of railcar. As a further example, the angles of and distances between bends 320 may be adjusted based on the desired support of side post portion 315 and/or the material of integrated side sheet 305. In this manner, integrated side sheet 305 may be adapted for use in a variety of railcars, while still retaining the core advantages discussed throughout this disclosure.

In certain embodiments, side wall 300 may contain further elements, such as top and bottom chords or bars along the length of side wall 300 in the first direction 350. These may provide additional support of side wall 300 and/or help integrated side wall 300 with further elements of the railcar during its construction. Some or all other elements of conventional railcar construction may be unchanged when incorporating embodiments of this new side wall 300 fabrication.

Figure 4C:
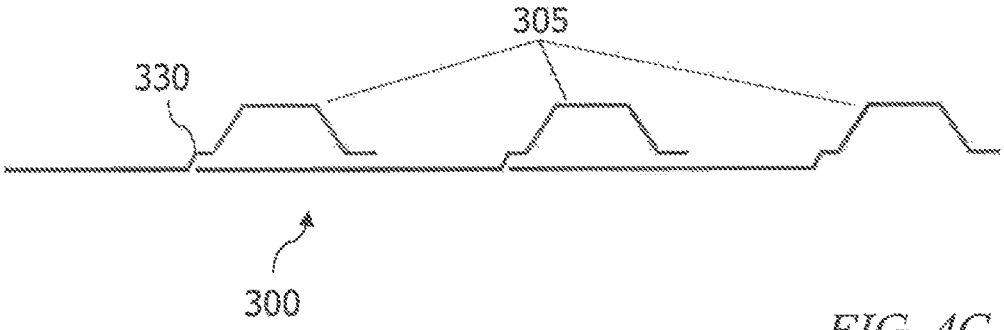
FIG. 4C illustrates a top-down view of the example side wall constructed using a plurality of the example integrated side sheets, in accordance with certain embodiments.

FIG. 4C illustrates a top-down view of example side wall 300 constructed using a plurality of integrated side sheets 305. The top-down view illustrates the function of offset bend 330 in constructing side wall 300. For example, as adjacent ones of integrated side sheet 305 are aligned overlapping, offset bend 330 provides an indentation or space where flat portion 310 of integrated side sheet 305 may be placed. As a result, a plurality of integrated side sheets 305 may be aligned to form flat surface of side wall 305. Additionally, this may also aid in welding integrated side sheets 305 by removing the need to further alter the shape of integrated side sheets 305 because integrated side sheets 305 are already aligned in a smooth surface.

Figure 5:
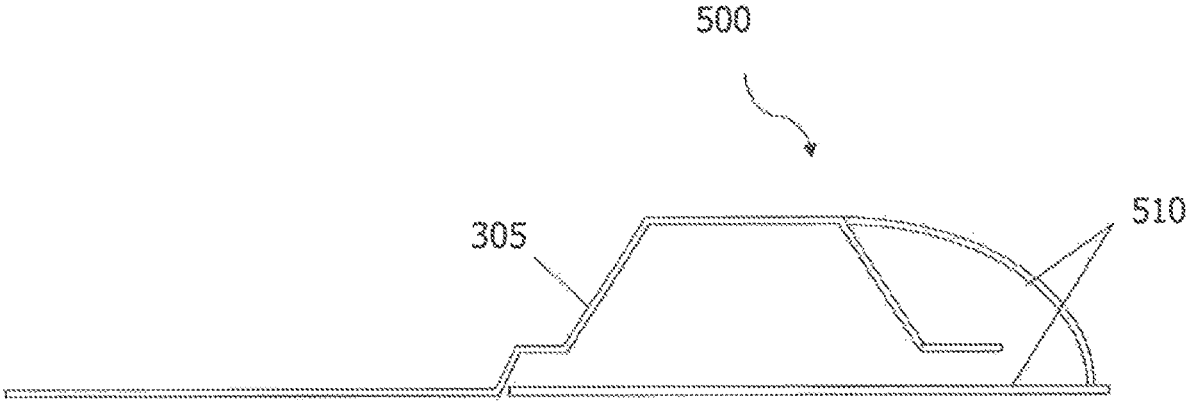
FIG. 5 illustrates a top-down view of an example door post using an example integrated side sheet, in accordance with certain embodiments.

FIG. 5 illustrates a top-down view of an example door post 500 using an example integrated side sheet 305. At an end of a side wall of a box car, e.g., side wall 105 or 300, a door post may be formed adjacent to the door of the box car. Integrated sides sheets 305 may be adapted to form door post 500 using portions of integrated side sheets 305. For example, in certain embodiments, an integrated side sheet 305 at the end of side wall 300 adjacent to the door may be modified by fastening, e.g., welding, additional metal pieces 510 to side post portion 315. Metal pieces 510 may provide additional support to side post portion 315 of integrated side sheet 305 to provide sufficient support for door post 500.

In certain embodiments, each side wail 300 may include door post 500. For example, a box car may include 2 or 4 door posts 500 at the ends of side walls 300 adjacent to the door of the box car. In this manner, the construction of side wall 300 may be simplified by using a single component, integrated side sheet 305, that integrates multiple components conventionally used in box car construction, namely side sheets 110, side posts 115, and depressions used to dispose lading anchors.

Figure 6:
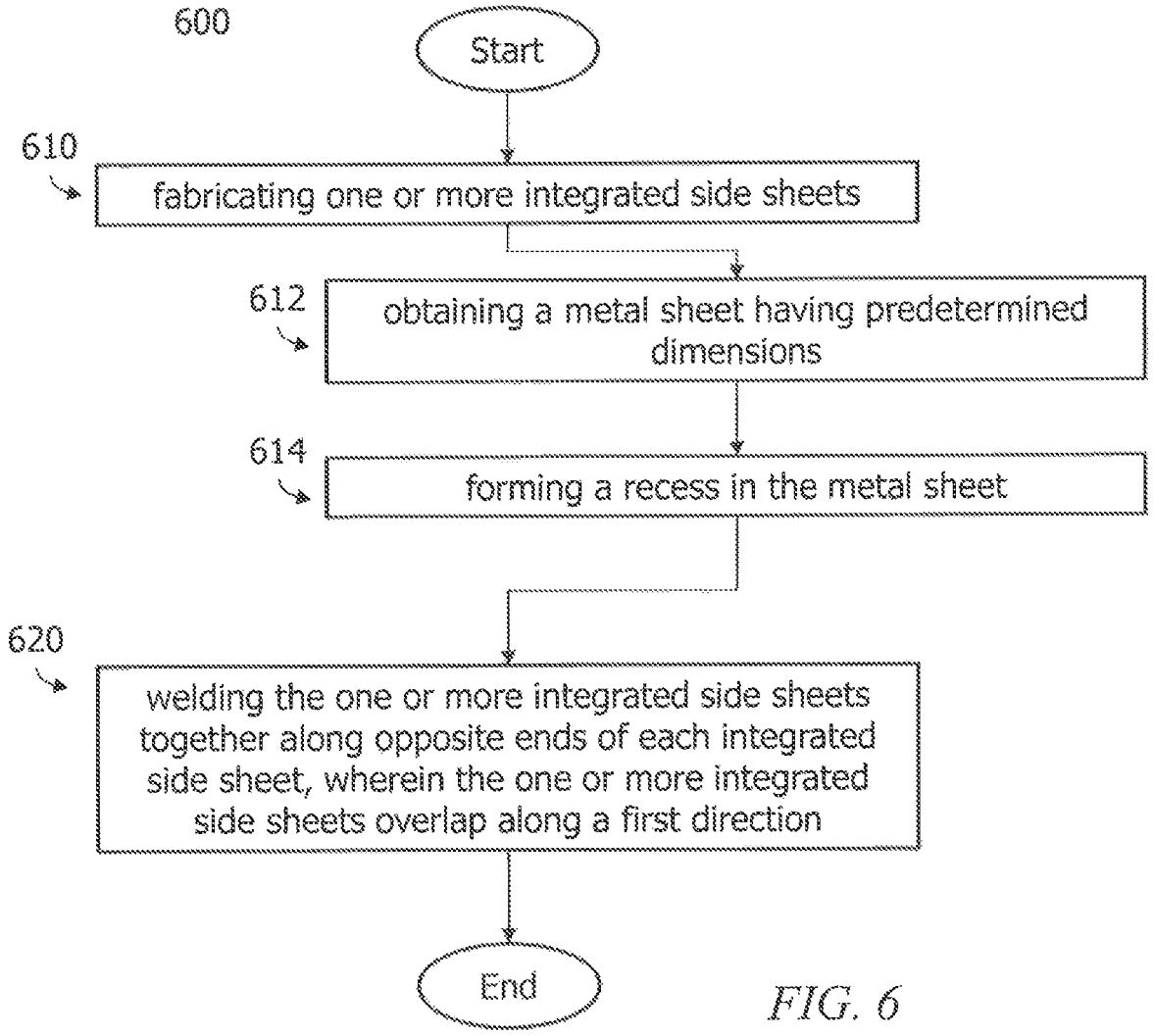
FIG. 6 is a flowchart diagram of a first example method for constructing a side wall of a railcar with one or more integrated side sheets, in accordance with certain embodiments.

FIG. 6 is a flowchart diagram of method 600 for constructing a side wall of a railcar with one or more integrated side sheets, such as integrated side sheets 305. Method 600 may begin al step 610, in which one or more integrated side sheets are constructed. For example, one or more integrated side sheets 305, as described above, may be constructed. Step 610 may include one or more sub steps. In certain embodiments, step 610 includes sub step 612, wherein metal sheet having predetermined dimensions is obtained. For example, the predetermined dimensions of the sheet of metal may be based on the target railcar for which this side wall is being fabricated. The same dimensions may be provided for each sheet, of metal such that each of the one or more integrated side sheets constructed at step 610 have the same dimensions. A standard size for the metal sheets may be approximately 154 inches tall and 47 inches wide to match the standard sizes of railcars used in the industry, however, any suitable size of metal sheet may be used.

Step 610 may further include sub step 614, in which a recess is formed within the sheet of metal. For example, recess 325 of integrated sides sheet 305 may be formed, thereby providing the structure to provide side post portion 315. Any suitable method of forming the recess are contemplated herein. For example, the metal sheet may be roll formed to bend the metal sheet at predetermined distances along the sheet of metal in a first direction to form the recess in the sheet of metal. As another example, the recess may be formed using a brake press machine and a preformed template.

Once the integrated side sheets are constructed, method 600 may move to step 620. At step 620, the one or more integrated side sheets are welded together along opposite ends of each integrated side sheet. The one or more integrated side sheets are positioned such that they overlap along the first direction. As an example, the integrated side sheets may be welded similarly to integrated side sheets 305 in FIGS. 4A and 4B. As a result, a side wall for a railcar car is fabricated.

In certain embodiments, step 610 includes one or more further sub steps. For example, in some embodiments, fabricating each integrated side sheet further includes forming an offset bend. The offset bend is configured to accommodate an adjacent portion of an integrated side sheet such that adjacent integrated side sheets are aligned. As discussed above, this may aid in fastening adjacent integrated side sheets together to form the side wall that has a straight and smooth surface.

As another example, in some embodiments, fabricating each integrated side sheet further includes forming a depression in the sheet of metal on a portion of the sheet of metal not forming the recess. In some embodiments, fabricating each integrated side sheet further comprises disposing a lading anchor in the depression. In some embodiments, disposing the lading anchor in the depression occurs after the integrated side sheets are constructed and/or after the integrated side sheets are welded together. For example, lading anchors may be disposed in each of the depressions in each of the integrated side sheets as a single process for the entire side wall. As a result, method 600 may result in a side wall using a single component, an integrated side sheet constructed to include a flat portion exposed to the interior, a supporting side post portion, and an anchor depression.

In certain embodiments, welding the one or more integrated side sheets together along opposite ends of each integrated side sheet includes welding each integrated side sheet along a second direction perpendicular to the first direction at a first end of the integrated side sheet proximate the offset bend and a second end opposite the first end. For example, welding may include providing welds 360 and 365 along second direction 355 aa depicted in FIGS. 4A and 4B.

Any steps or features described herein are merely illustrative of certain embodiments. It is not required that all embodiments incorporate all the steps or features disclosed nor that the steps be performed in the exact order depicted or described herein. Furthermore, some embodiments may include steps or features not illustrated or described herein, including steps inherent to one or more of the steps disclosed herein.

Modifications, additions, or omissions may be made to the methods described herein without departing from the scope of the disclosure. The methods may include more, fewer, or other steps. Additionally, steps may be performed in any suitable order.

Additionally, particular embodiments may be described further below. In one embodiment, a railcar includes a side wall including one or more integrated side sheets. Each of the one or more integrated side sheets includes a sheet of metal having a flat portion and a side post portion adjacent to the flat portion. The side post portion includes one or more bends in the sheet of metal that form a recess in the sheet of metal. In some embodiments, the side post portion further includes an offset bend between the side post portion and the flat portion, the offset bend configured to accommodate an adjacent portion of an integrated side sheet such that adjacent integrated side sheets are aligned.

In another example embodiment, for at least one of the one or more integrated side sheets, the sheet of metal further comprises a depression in the flat portion of the sheet of metal. In some embodiments, a lading anchor is disposal in the depression of the flat portion of the sheet of metal of the at least one integrated side sheets.

In another example embodiment, the side wall is constructed with the one or more integrated side sheets welded to adjacent integrated side sheets at opposite ends of the integrated side sheets. For example, in some embodiments, the side wall is constructed with the one or more integrated side sheets welded to adjacent integrated side sheets at a first end of the integrated side sheet proximate the offset bend and a send end proximate the flat portion opposite the first end. Further in specific embodiments, each of the plurality of integrated side sheets comprises one or more rib portions formed on the flat portion.

In another embodiment, a method is provided for constructing a side wall of a railcar. The method includes fabricating one or more integrated side sheets. Fabricating each integrated side sheet includes obtaining a metal sheet having predetermined dimensions and forming a recess in the metal sheet. The method further includes welding the one or more integrated side sheets together along opposite ends of each integrated side sheet. The one or more integrated side sheets overlap along the first direction. In some embodiments, fabricating each integrated side sheet further includes terming an offset bend. The offset bend is configured to accommodate an adjacent portion of an integrated side sheet such that adjacent integrated side sheets are aligned. In some embodiments, welding the one or more integrated side sheets together along opposite ends of each integrated side sheet includes welding each integrated side sheet along a second direction perpendicular to the first direction at a first end of the integrated side sheet proximate the offset bend and a second end opposite the first end.

In some embodiments, forming the recess in the metal sheet includes roll forming the metal sheet. In other embodiments, forming the recess in the metal sheet comprises brake pressing the metal sheet.

In some embodiments, fabricating each integrated side sheet further includes forming one or more depressions in the sheet of metal on a portion of the sheet of metal not forming the recess. In particular embodiments, the method further includes disposing one or more lading anchors in the one or more depressions.

Figure 7A:
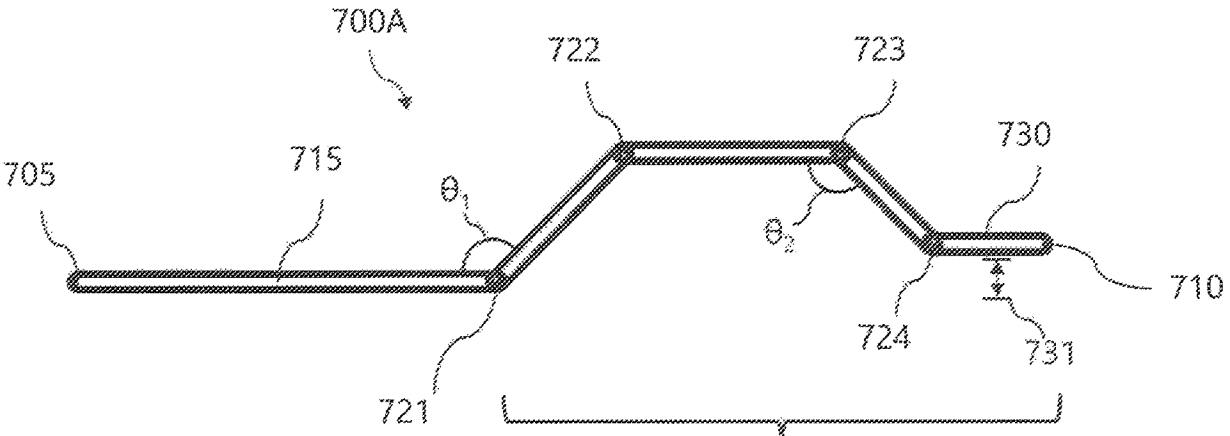
FIGS. 7A and 7B illustrate a pair of configurations of the example side sheet, in accordance with certain embodiments.

FIG. 7A illustrates a first example configuration of an integrated side sheet 700A that may be incorporated into a railcar side wall, such as side wall 300 illustrated in FIGS. 4A and 4B. As described above with reference to integrated side sheet 305, integrated side sheet 700A may include a metal sheet Including a flat area portion 715 and a side post portion 720. Side post portion 720 may include a plurality of bends that define the recess, e.g., the extension of the sheet of metal outside the plane defined by flat area portion 715. For example, in certain embodiments, side post portion 720 of integrated side sheet 700A includes a first bend 721, a second bend 722, a third bend 723, and a fourth bend 724. As shown in the illustrated example in FIG. 7A, flat area portion 715 extends a first distance from first end 705 to first bend 721.

The sheet of metal further extends a second distance at a first, non-zero angle $\theta_1$ relative to flat area portion 715 between first bend 721 and second bend 722. The sheet of metal further extends a third distance parallel to flat area portion 715 between second bend 722 and third bend 723. Further, the sheet of metal extends a fourth distance at a second, non-zero angle relative $\theta_2$ to flat area portion 715 between third bend 723 and fourth bend 724. In certain embodiments, side post portion 720 further includes an end portion 730 extending a fifth distance parallel to flat area portion 715 from fourth bend 724 to a second end 710 of the sheet of metal. As a result, integrated side sheet 700A may incorporate a support structure, e.g., side post portion 720, into a single integrated component.

As described above, integrated side sheet 700A may be constructed via a series of bends of the sheet of metal. For example, bends 721, 722, 723, 724 may be formed by any suitable method of forming a sheet of metal, including but not limited to roll forming the metal sheet or brake pressing the metal sheet.

Additionally, a side wall may be constructed using two or more integrated side sheets 700A. For example, in certain embodiments, a first integrated side sheet 700A may be disposed adjacent to a second integrated side sheet 700A of the plurality of side sheets. The respective first end 705 of second integrated side sheet 700A is disposed proximate to respective first bend 721 of respective side post portion 720 of first integrated side sheet 700A. In this manner, the side wall may be constructed using a series of single integrated side sheets 700A, thereby reducing the number of components required during construction and reducing the amount of processing or welding to complete construction of the railcar side wall. To accommodate the overlap, integrated side sheet 700A may define one or more layering points over which an adjacent integrated side sheet 700A may be disposed. For example, in some embodiments, end portion 730 of side post portion 720 extends parallel to flat area portion 715 at an offset distance 731 above the plane defined by flat area portion 715. Offset distance 731 may be equal to or greater than a thickness of integrated side sheet 700A at its flat area portion 715. In this manner, the desired overlapping portion of integrated side sheet 700A, e.g., over the recess defined by side post portion 720, may be configured to accommodate the adjacent integrated side sheet, thereby allowing for adjacent flat area portions 715 to be disposed flush against another to form a straight face of the side wall.

Figure 7B:
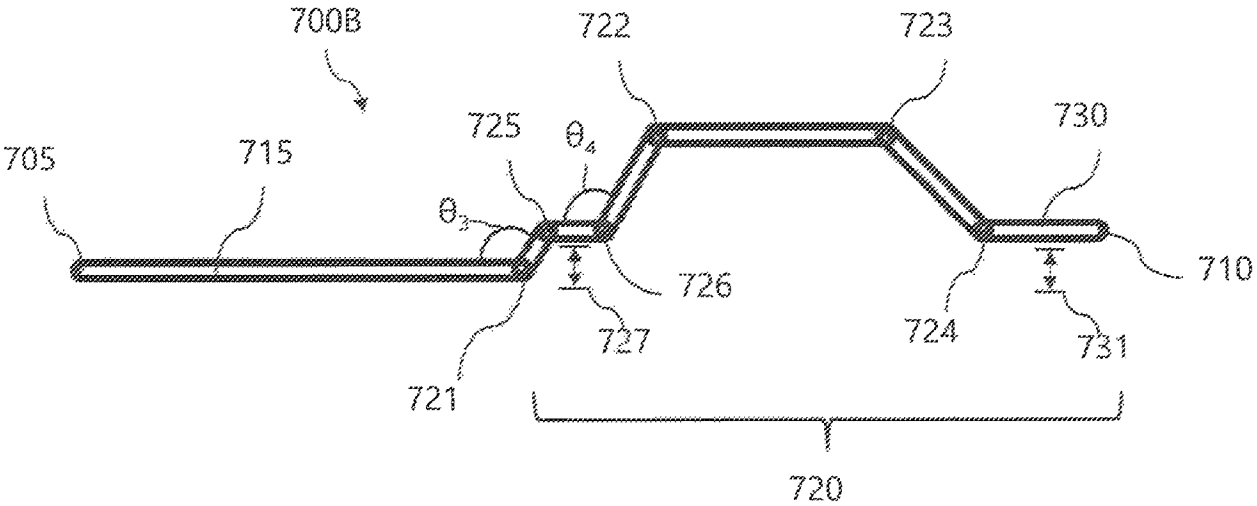

FIG. 7B illustrates a second configuration of integrated side sheet 700B incorporating an additional structure. Integrated side sheet 700B may include similar components as described above in reference to integrated side sheet 700A, but also include one or more additional bends to provide further benefits and advantages. In particular, in certain embodiments, integrated side sheet 700B further includes a fifth bend 725 and a sixth bend 726 between first bend 721 and second bend 722. For example, the sheet of metal may extend for a first portion of the second distance between first bend 721 and second bend 722 at a third, non-zero angle $\theta_3$ relative to the fiat area portion 715 between first bend 721 and fifth bend 725. For example, third, non-zero angle $\theta_3$ may be the same as first, non-zero angle $\theta_1$ as described above. In some embodiments the angles are different when including fifth and sixth bends 725, 726 (e.g., to provide the additional bends in the same span of the metal sheet). Additionally, the sheet of metal may extend for a second portion of the second distance parallel to flat area portion 715 between fifth bend 725 and sixth bend 726. Further, the sheet of metal may extend for a third portion of the second distance at a fourth, non-zero angle relative $\theta_4$ flat area portion 715 between sixth bend 726 and second bend 722.

The combination of fifth bend 725 and sixth bend 726 may be referred to an offset bend and may be configured to accommodate a first end 705 of an adjacent integrated side sheet 700B (or integrated side sheet 700A). For example, in certain embodiments, wherein a distance 727 is provided between flat area portion 715 of the sheet of metal and the sheet of metal extending between fifth bend 725 and sixth bend 726. Distance 727 may be equal to or greater than a thickness of a thickness of an adjacent sheet of metal (e.g., a portion of an adjacent integrated side sheet 700A, 700B at its respective flat area portion of the sheet of metal). In this manner, an adjacent sheet of metal may be laid down flush against flat area portion 715 of integrated side sheet 700B. Additionally, the additional fifth and sixth bends, 725, 726, may provide additional surface area of the sheet of metal for welding adjacent integrated side sheets 700A, 700B, or additional railcar components proximate first bend 721. Accordingly, the second configuration of integrated side sheet 700B may include additional bends in the sheet of metal to provide enhanced constructability of the railcar side wall.

In certain embodiments, the side wall incorporating one or more integrated side sheets 700A, 700B may be disposed between an end of the railcar and a door in the railcar. For example, a railcar may include two side walls on a single side of the railcar, one on each side of the door between the ends of the railcar. In certain embodiments, the dimensions of integrated side sheets 700A, 700B may be configured to provide an even spacing of respective integrated side post portions 720 between the end of the car and the posts of the door. In this manner, additional cutting or trimming of the metal sheet in which integrated side sheets 700A, 700B are formed may be reduced or eliminated, thereby improving constructability and reducing potential areas of process failure.

FIGS. 7A and 7B illustrates integrated side sheets 700A and 700B in an edge-on view. For example, the illustrated examples may be viewed as from above, e.g., head on with top side edge 341, or as from below, e.g., bead on with bottom side edge 342. In some embodiments, side post portions 720 may be disposed on the "right" side of integrated side sheets 700A, 700B when integrated into a side wall for a railcar. In some embodiments, side post portions 720 may be disposed on the "left" side of integrated side sheets 700A, 700B when integrated into a side wall for a railcar. In some embodiments, side post portions 720 may be disposed on the "left" side of integrated side sheets 700A, 700B for a first portion of a railcar (e.g., one side wail of the railcar) and disposed on the "right" side for a second portion of the railcar. In this manner, the orientation and placement of side post portion 720 within integrated side sheets 700A and 700B may be configured for the particular intended use.

According to certain embodiments, integrated side sheets 700A and 700B may include additional support structures. For example, in some embodiments, a further side post or recess area may be formed within the same sheet of metal in which side post portion 720 is formed. In one example embodiment, bends 721-724 may be repeated between fourth bend 724 and second end 710 of the sheet of metal to form a second recess. In this manner, two side post portions 720 may be formed on the same metal sheet. Accordingly, live density of support structures may be increased while maintaining a single, repeatable integrated side sheet 700A, 700B. As another example embodiment, different bends may be made between fourth bend 724 and second end 710 of the sheet of metal. For example, only two or three bends may be used to create a second recess in the sheet of metal. As another example, four or more bends may be made. As yet another example, the bends between fourth bend 724 and second end 710 are different from bends 721-724 (or bends 721-726) of side post portion 720. The bends of the second recess may, for example, be bent at different angles then bends 721-724 of side post portion 720 or the sheet of metal may extend at different distances between the bends of the second recess. In this manner, multiple recesses may be defined in the sheet of metal, thereby increasing the number of support structures integrated into side sheet 700A, 700B.

Additionally, integrated side sheets 700A, 700B may define any number of recesses. Although an example embodiment of a second recess is described above, a third recess (or fourth or fifth, etc.) may also be defined in the sheet of metal. Any number of recesses may be defined by further bends in the same sheet of metal. In this way, integrated side sheets 700A, 700B may be further strengthened. Further, adjacent integrated side sheets 700A, 700B may be overlapped such that flat area portion 715 overlaps with one, two, etc. recesses defined in the adjacent integrated side sheet 700A, 700B. For example, fiat area portion 715 may overlap with all of the recesses defined in an adjacent integrated side sheet 700A, 700B. As another example, fiat area portion 715 may overlap with just one or any number less than the number of recesses defined in the adjacent integrated side sheet 700A, 700B. In this manner, the strength and composite length of the side wall comprising integrated side sheets 700A, 700B may be adjusted for particular configurations and railcars.

Figure 8:
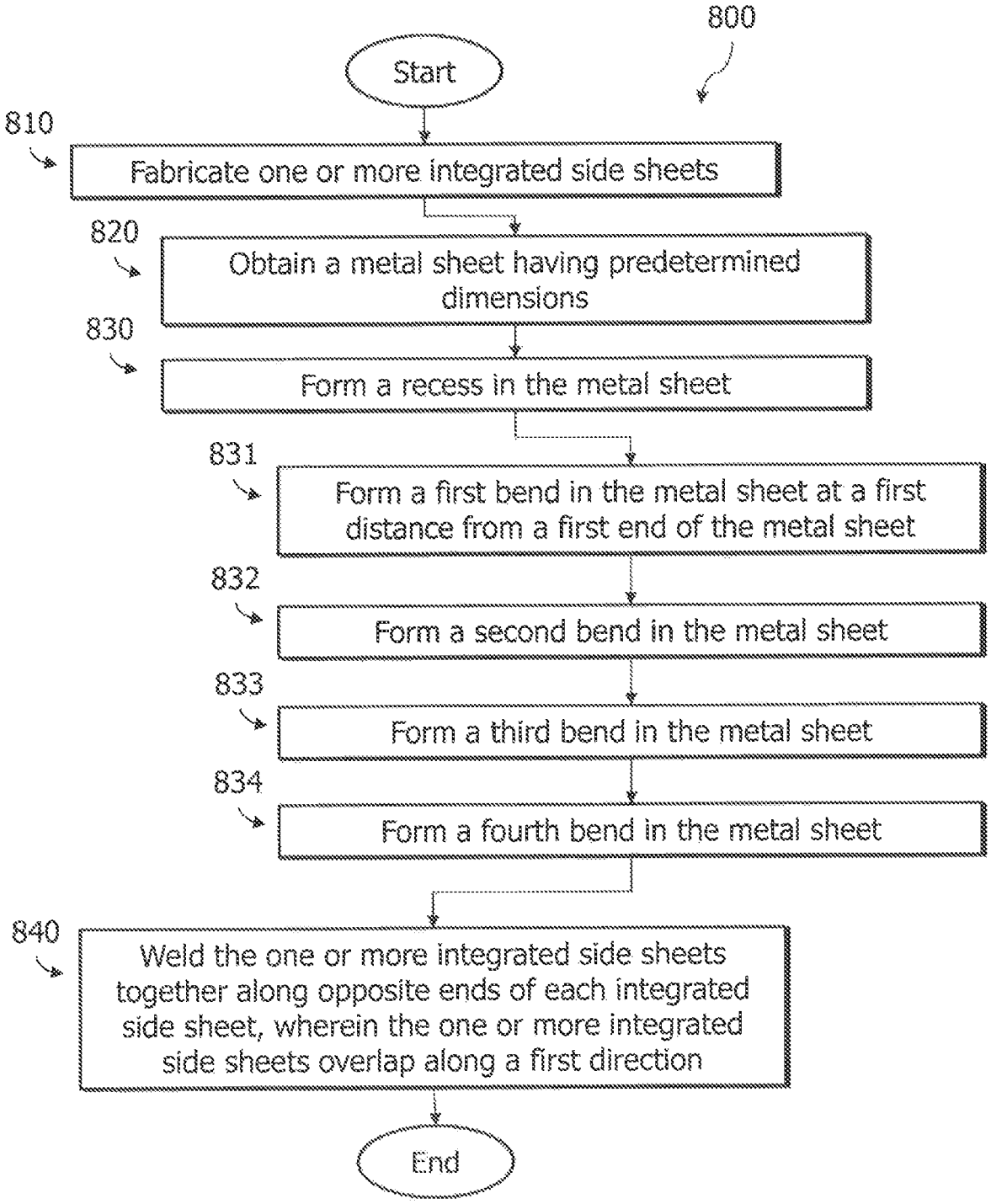
FIG. 8 is a flowchart diagram of a second example method of constructing a side wall of a railcar with one or more integrated side sheets, in accordance with certain embodiments.

FIG. 8 is a flowchart diagram of a second example method 800 of constructing a side wall of a railcar with one or more integrated side sheets (e.g., integrated sides sheets 305 or integrated sides sheets 700A, 700B), in accordance with certain embodiments. At step 810, one or more integrated side sheets may be fabricated. For example, one or more of integrated side sheets 305 or integrated side sheets 700A or 700B may be fabricated. Fabricating each integrated side sheet may include substeps 820 in which a metal sheet having predetermined dimensions is obtained and 830 in which a recess is formed in the metal sheet.

Forming the recess in the metal sheet may include one or more substeps. For example, at step 831 a first bend in the metal sheet may be formed at first distance from a first end of the metal sheet (e.g., first bend 721 at a first distance from first end 705). The first bend in the metal sheet defines a fiat area portion (e.g., flat area portion 715) between the first end and the first bend (e.g., first end 705 and first bend 721) and a side post portion (e.g., side post portion 720) between the first bend and a second end (e.g., second end 710) of the metal sheet opposite the first end.

At step 831, a second bend (e.g., second bend 722) is formed in the metal sheet. The metal sheet extends a second distance at a first, non-zero angle relative to the flat area portion between the first bend and the second bend. At step 832, a third bend (e.g., third bend 723) is formed in the metal sheet. The metal sheet extends a third distance parallel to the flat area portion between the second bend and the third bend. At step 833, a fourth bend (e.g., fourth bend 724) is formed in the metal sheet. The metal sheet extends a fourth distance at a second, non-zero angle relative to the flat area portion between the third bend and the fourth bend. The fourth bend may form an end portion (e.g., end portion 730) extending a fifth distance parallel to the flat area portion from the fourth bend towards the second end of the metal sheet. As a result, a recess is formed in the metal sheet including a plurality of bends. The recess and defining portion of the sheet of metal may provide an integrated support structure, thereby reducing the need for additional separate support structures from being added to side sheets to construct a railcar side wall. Further, each of the bend-forming steps may be carried out in any suitable method, e.g., roll forming and/or brake pressing the metal sheet.

At step 840, the one or more integrated side sheets arc welded together to form a side wall for a railcar. For example, the one or more integrated side sheets may be disposed in a series of overlapping integrated side sheets, such that the flat area portions of the integrated side sheets overlap with the side post portion. Welding the integrated side sheets together may include welding the first end of the integrated side sheet proximate the first bend of the side post portion. As a result, a side wall or portion thereof may be provided with integrated support structures and including a substantially flat surface (e.g., the series of adjacent flat area portions coupled together into the side wall).

In certain embodiments, method 800 includes one or more steps. For example, in some embodiments, forming the recess in the metal sheet may include additional bend-forming steps. For example, method 800 may further include forming an offset bend. The offset bend may be formed by forming a fifth bend between the first bend and the second bend of the metal sheet and forming a sixth bend between the fifth bend and the second bend of the metal sheet. As a result, the metal sheet may extend for a first portion of the second distance at a third, non-zero angle relative to the flat area portion between the first bend and the fifth bend. Further, the metal sheet may extend for a second portion of the second distance parallel to the flat area portion between the fifth bend and the sixth bend and extend for a third portion of the second distance at a fourth, non-zero angle relative to the fat area portion between the sixth bend and the second bend. As described herein, the formed offset bend may be configured to accommodate an adjacent portion of an integrated side sheet such that adjacent integrated side sheets are aligned. This may further aid in the alignment and coupling of adjacent integrated side sheets, as described herein.

As another example, in some embodiments, one or more additional recesses may be formed in the metal sheet between the fourth bend and the second end of the metal sheet. In particular, method 800 may further include a step of forming a second recess, including forming one or more additional bends in the metal sheet. In some embodiments, the method further includes forming a series of bends to form the second recess. In one example embodiment, the recess formed in forming the first, second, third, and fourth bends, is repeated by forming an additional three or four bends. In this manner, the side post portion may be repeated to further strengthen the integrated side sheets making up the side wall of the railcar.

Any steps or features described herein are merely illustrative of certain embodiments. It is not required that all embodiments incorporate all the steps or features disclosed nor that the steps be performed in the exact order depicted or described herein. Furthermore, some embodiments may include steps or features not illustrated or described herein, including steps inherent to one or more of the steps disclosed herein.

Modifications, additions, or omissions may be made to the methods described herein without departing from the scope of the disclosure. The methods may include more, fewer, or other steps. Additionally, steps may be performed in any suitable order.

Certain aspects of the inventive concept have mainly been described above with reference to a few embodiments. However, as is readily appreciated by a person skilled in the art, embodiments other than the ones disclosed above arc equally possible and within the scope of the inventive concept. Similarly, while a number of different combinations have been discussed, all possible combinations have not been disclosed. One skilled in the art would appreciate that other combinations exist and arc within the scope of the inventive concept. Moreover, as is understood by the skilled person, the herein disclosed embodiments arc as such applicable also to other standards and communication systems and any feature from a particular figure disclosed in connection with other features may be applicable to any other figure and or combined with different features.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

The invention claimed is:

1. A side wall for a railcar, the side wall comprising:

a plurality of integrated side sheets, wherein each of the integrated side sheets comprises a sheet of metal comprising:

a first end and a second end opposite the first end;

a top side edge extending from the first end to the second end;

a bottom side edge extending from the first end to the second end;

a flat area portion extending a first distance from the first end towards the second end between the top side edge and the bottom side edge;

a side post portion adjacent to the flat area portion, the side post portion comprising a plurality of bends forming a recess;

wherein the plurality of bends comprises:

a first bend;

a second bend, wherein the sheet of metal extends a second distance at a first, non-zero angle relative to the flat area portion between the first bend and the second bend;

a third bend, wherein the sheet of metal extends a third distance parallel to the flat area portion between the second bend and the third bend; and a fourth bend, wherein the sheet of metal extends a fourth distance at a second, non-zero angle relative to the flat area portion between the third bend and the fourth bend:

wherein the side post portion further comprises an end portion extending a fifth distance parallel to the flat area portion from the fourth bend towards the second end of the sheet of metal;

wherein the plurality of bends further comprises a fifth bend and sixth bend between the first bend and the second bend of the sheet of metal;

wherein the fifth bend and the sixth bend form an offset bend that is configured to accommodate an adjacent portion of an integrated side sheet such that adjacent integrated side sheets are aligned; and wherein:

the sheet of metal extends for a first portion of the second distance at a third, non- zero angle relative to the flat area portion between the first bend and the fifth bend;

the sheet of metal extends for a second portion of the second distance parallel to the flat area portion between the fifth bend and the sixth bend; and the sheet of metal extends for a third portion of the second distance at a fourth, non-zero angle relative to the flat area portion between the sixth bend and the second bend.

2. The side wall of claim 1, wherein a first integrated side sheet of the plurality of the integrated side sheets is disposed adjacent to a second integrated side sheet of the plurality of side sheets, wherein the respective first end of the second integrated side sheet is disposed proximate to the respective first bend of the plurality of bends of the respective side post portion of the sheet of metal of the first integrated side sheet.

3. The side wall of claim 1, wherein the end portion of the side post portion extends parallel to the flat area portion at an offset distance above the plane defined by the flat area portion, wherein the offset distance is equal to or greater than a thickness of an integrated side sheet at its respective flat area portion of the sheet of metal.

4. The side wall of claim 1, wherein the flat area portion of the sheet of metal comprises one or more depressions, wherein the one or more depressions are each configured to accommodate a lading anchor disposed in the respective depression.

5. The side wall of claim 1, wherein the plurality of integrated side sheets are welded together such that the side post portion of a respective integrated side sheet overlaps with the flat area portion of an adjacent integrated side sheet.

6. The side wall of claim 1, wherein a distance between the flat area portion of the sheet of metal and the sheet of metal extending for the second portion of the second distance parallel to the flat area portion is equal to or greater than a thickness of a thickness of an integrated side sheet at its respective flat area portion of the sheet of metal.

7. The side wall of claim 1, wherein the sheet of metal further comprises a second set of bends between the fourth bend and the second end of the sheet of metal, the second set of bends forming a second recess in the sheet of metal.

8. A method for constructing a side wall for a railcar, comprising fabricating one or more integrated side sheets, wherein fabricating each integrated side sheet comprises:

obtaining a metal sheet having predetermined dimensions; and forming a recess in the metal sheet, wherein forming the recess in the metal sheet comprises:

forming a first bend in the metal sheet at a first distance from a first end of the metal sheet, wherein the first bend in the metal sheet defines a flat area portion between the first end and the first bend and a side post portion between the first bend and a second end of the metal sheet opposite the first end;

forming a second bend in the metal sheet, wherein metal sheet extends a second distance at a first, non-zero angle relative to the flat area portion between the first bend and the second bend;

forming a third bend in the metal sheet, wherein the metal sheet extends a third distance parallel to the flat area portion between the second bend and the third bend; and forming a fourth bend in the metal sheet, wherein the metal sheet extends a fourth distance at a second, non-zero angle relative to the flat area portion between the third bend and the fourth bend; and wherein the fourth bend forms an end portion extending a fifth distance parallel to the flat area portion from the fourth bend towards the second end of the metal sheet; and welding the one or more integrated side sheets together to form a side wall for a railcar;

wherein forming the recess in the metal sheet further comprises forming an offset bend, wherein forming the offset bend comprises:

forming a fifth bend between the first bend and the second bend of the metal sheet, the metal sheet extending for a first portion of the second distance at a third, non-zero angle relative to the flat area portion between the first bend and the fifth bend; and forming a sixth bend between the fifth bend and the second bend of the metal sheet, the metal sheet extending for a second portion of the second distance parallel to the flat area portion between the fifth bend and the sixth bend and extending for a third portion of the second distance at a fourth, non-zero angle relative to the flat area portion between the sixth bend and the second bend; and wherein the offset bend is configured to accommodate an adjacent portion of an integrated side sheet such that adjacent integrated side sheets are aligned.

9. The method of claim 8, wherein forming the recess in the metal sheet comprises roll forming the metal sheet.

10. The method of claim 8, wherein forming the recess in the metal sheet comprises brake pressing the metal sheet.

11. The method of claim 8, wherein fabricating each integrated side sheet further comprises forming one or more depressions in the flat area portion of the metal sheet.

12. The method of claim 11, further comprising disposing one or more lading anchors in the one or more depressions formed in the flat area portion of the metal sheet.

13. The method of claim 8, wherein welding the one or more integrated side sheets together comprises welding the first end of a respective integrated side sheet proximate to a first bend of an adjacent integrated side sheet such that the flat area portion of the respective integrated side sheet and the flat area portion of the adjacent integrated side sheet are substantially parallel.

14. A railcar, comprising:

a cargo space defined by at least two side walls and two end walls;

wherein each of the two side walls comprises two or more integrated side sheets, wherein each of the two integrated side sheets comprises a sheet of metal comprising:

a first end and a second end opposite the first end;

a top side edge extending from the first end to the second end;

a bottom side edge extending from the first end to the second end;

a flat area portion extending a first distance from the first end towards the second end between the top side edge and the bottom side edge; and a side post portion adjacent to the flat area portion, the side post portion comprising a plurality of bends forming a recess;

wherein the plurality of bends comprises:

a first bend;

a second bend, wherein the sheet of metal extends a second distance at a first, non-zero angle relative to the flat area portion between the first bend and the second bend;

a third bend, wherein the sheet of metal extends a third distance parallel to the flat area portion between the second bend and the third bend; and a fourth bend, wherein the sheet of metal extends a fourth distance at a second, non-zero angle relative to the flat area portion between the third bend and the fourth bend;

wherein the side post portion further comprises an end portion extending a fifth distance parallel to the flat area portion from the fourth bend towards the second end of the sheet of metal:

wherein the plurality of bends further comprises a fifth bend and sixth bend between the first bend and the second bend of the sheet of metal; and wherein:

the sheet of metal extends for a first portion of the second distance at a third, non-zero angle relative to the flat area portion between the first bend and the fifth bend;

the sheet of metal extends for a second portion of the second distance parallel to the flat area portion between the fifth bend and the sixth bend; and the sheet of metal extends for a third portion of the second distance at a fourth, non-zero angle relative to the flat area portion between the sixth bend and the second bend.

15. The railcar of claim 14, wherein a first integrated side sheet of the at least two integrated side sheets is disposed adjacent to a second integrated side sheet of the at least two integrated side sheets, wherein the respective first end of the second integrated side sheet is disposed proximate to the respective first bend of the plurality of bends of the respective side post portion of the sheet of metal of the first integrated side sheet.

16. The railcar of claim 14, wherein the flat area portion of the sheet of metal comprises one or more depressions, wherein the one or more depressions are each configured to accommodate a lading anchor disposed in the respective depression.

* * * * *